US005444895A

United States Patent [19]

Salice

[11] Patent Number: 5,444,895

[45] Date of Patent: Aug. 29, 1995

[54] FURNITURE HINGE

[75] Inventor: Luciano Salice, Carimate, Italy

[73] Assignee: Arturo Salice S.p.A., Novedrate, Italy

[21] Appl. No.: 141,952

[22] Filed: Oct. 28, 1993

[30] Foreign Application Priority Data

Oct. 28, 1992 [DE] Germany ..... 42 36 444.2

[51] Int. Cl.[6] ..... E05F 1/12; E05F 1/14

[52] U.S. Cl. ..... 16/278; 16/288; 16/245

[58] Field of Search ..... 16/239, 240, 241, 278, 16/288, 294, 296, DIG. 43, 242, 245, 246

[56] References Cited

U.S. PATENT DOCUMENTS

| | | | |
|---|---|---|---|
| 3,940,828 | 3/1976 | Lautenschlaeger | 16/288 |
| 4,050,116 | 9/1977 | Salice | 16/288 |
| 4,117,569 | 10/1978 | Lautenschlager et al. | 16/278 |
| 4,457,047 | 7/1984 | Lautenschlager | 16/288 |
| 4,543,686 | 10/1985 | Rock et al. | 16/288 |
| 5,029,362 | 7/1991 | Prodan | 16/240 |
| 5,099,547 | 3/1992 | Salice | 16/239 |

FOREIGN PATENT DOCUMENTS

| | | | |
|---|---|---|---|
| 0050320 | 4/1982 | European Pat. Off. | 16/288 |
| 0453829 | 10/1991 | European Pat. Off. | 16/278 |
| 2401178 | 7/1975 | Germany | 16/278 |
| 2920156 | 11/1979 | Germany | 16/288 |
| 3442421 | 6/1986 | Germany | 16/240 |

*Primary Examiner*—Lowell A. Larson
*Assistant Examiner*—Donald M. Gurley
*Attorney, Agent, or Firm*—Jacobson, Price, Holman & Stern

[57] ABSTRACT

A hinge includes a stationary fitting base plate part, which fitting base plate part is connected with a pivotal fitting part. The hinge is able to be pivoted for lateral adjustment of a door or flap carried by the pivotal fitting part, in relation to the base plate part by a setting device in the pivot plane of the hinge. A stop member which bears on a hinge arm and is acted upon by a resilient element, is, via a cam, able to be pivoted with the pivotal fitting part and urges the pivotal fitting part in the closing part of its range of movement towards its closed position whereas outside such closing range it is rendered ineffective by the cam. To ensure that, when performing lateral adjustment by pivoting the hinge arm, that the closing device still remains effective in the closing range, the bearing member of the stop member is so linked with the hinge arm and with the base plate by guides and/or transmission members that it is moved by each pivotal movement of the hinge arm in relation to the base plate into a setting, in which it maintains substantially the same position in relation to the cam in the closed position.

6 Claims, 6 Drawing Sheets

FURNITURE HINGE

FIELD OF THE INVENTION

The invention relates to a hinge, more particularly a furniture hinge, comprising a stationary fitting part designed in the form of a hinge with a base plate carrying it, which stationary fitting part is preferably connected via pivot levers with a pivotal fitting part, preferably a hinge female part, and which is able to be pivoted for lateral adjustment of a door or flap carried by the pivotal fitting part in relation to the base plate by means of a setting device in the pivot plane of the hinge, and a stop member which is bearing on the hinge arm and is acted upon it by a resilient element, which stop member via a cam is able to be pivoted with the pivotal fitting part to urge the pivotal fitting part, in the closing part of its range of movement, towards its closed position and outside such closing range is rendered ineffective by the cam.

BACKGROUND OF THE INVENTION

It is known from German patent publication 3,442,421 C to laterally adjust a door or flap borne by a furniture hinge in the pivot plane of the hinge relatively to the base plate bearing the same. If however for such lateral adjustment of a door the hinge arm is pivoted away from the base plate secured to a supporting wall, the hinge arm will assume a position in relation to the door at an obtuse angle which corresponds to a slight opening of the door, although the door, because it abuts against body parts or a door frame, is in its closed position. The German patent publication 3,442,421 C relates to a furniture hinge, whose pot-like, female pivotal hinge part is connected by means of two links with joint pins, arranged rectangularly or in trapezium with the hinge arm. In the case of such a four-link hinge, the joint gap, that is to say the distance between the end wall of the supporting wall and the door, when the door is opened a little so that the German patent publication 3,442,421 C relates to a design which the hinge arm is so made to move in guides of a base plate or intermediate plate that when there is a pivoting movement equal to the size of the change in the gap caused by the pivoting movement it is shifted in its longitudinal direction on the base plate or intermediate plate.

Hinges of the type initially mentioned, which are provided with only one joint or with two links in the manner described in German patent publication 3,442,421 C or furthermore with intersecting hinge arms in the case of so-called "wide angle hinges" are frequently provided with closing means, which urge the doors or flaps in the closing range movement thereof, that is to say in a small angular range of 5° to 8°, short of the completely closed position into such closed position. Such a closing device, which consists of a cam arranged adjacent to one joint, on which a spring-loaded thrust follower runs, is disclosed for instance in the German patent publication 2,401,178 A. The thrust follower, which is bearing on a spring-loaded pivot lever and consists of a roller, runs in the opening range on a curved cam which is concentric to the pivot axis so that the corresponding joint lever is not urged to perform a closing or opening movement and it is only in the closing movement range that it moves on a part of the cam approaching the joint pin so that in the closing range it produces a closing moment via the cam.

If however in the case of a lateral misalignment of the door, the door is merely moved through a small angle into its open position, the part of the cam which the thrust follower moves along to get into the closed position will be correspondingly shorter, this leading to a closing moment and meaning that, if the thrust follower is not completely prevented from coming onto the cam part producing a closing moment. The lateral adjustment of a door or flap by pivoting the hinge arm in the pivot plane of the hinge may also mean that the effect of a closing device with a cam and a thrust follower is reduced or completely overridden.

SUMMARY OF THE INVENTION

One object of the invention is therefore to provide a hinge of the type initially mentioned, in the case of which even when there is a lateral misalignment owing to pivoting of the hinge arm it is possible to ensure that the closing device maintains its effective action in the closing movement range without any change.

In accordance with the invention this object is to be achieved by a hinge of the type initially mentioned since the bearing means of the stop member is so linked with the hinge arm and with the base plate by guides and/or transmission members that it is moved by each pivotal movement of the hinge arm in relation to the base plate into a setting, in which it maintains substantially the same position in relation to the cam in the closed position.

The hinge in accordance with the invention consequently compensates for pivotal movements of the hinge arm by lateral adjustment in such a manner that even a setting movement derived from the hinge arm is transmitted to the stop member in such a manner that setting movements are-compensated for and in the closing range of movement the stop member maintains its position in relation to the cam at all settings without any modification so that the closing moment effective in the closing range and acting on the door remains unchanged in its effect. In the case of a hinge in accordance with the invention a lateral adjustment consequently does not affect the effect of the closing moment of the closing device so that the same remains effective in a manner independent from the setting always through the same small angle of opening corresponding to the closing range.

The invention is preferably utilized in the case of a hinge, in the case of the pivotal hinge part connected by two joint levers with the hinge arm, of which one bears on the cam adjacent to the pivot axis on the hinge arm.

The invention is more particularly able to be employed in the case of a hinge in accordance with the German Patent Publication 3,442,421 C provided additionally with a closing device, in which case when the hinge arm is pivoted for lateral adjustment two adaptations are simultaneously performed, i.e. on the one hand the longitudinal displacement of the hinge, arm in order to maintain an unchanged joint gap, and on the other hand, in order to perform the adaptation in accordance with the invention of the stop member to suit the cam.

In accordance with a further advantageous development of the invention the stop member consists of a spring-loaded lever, whose pivot pin is so guided in intersecting slot guides in the base plate or an intermediate plate secured to the same and in the hinge arm that the thrust follower thereof cooperating with the cam maintains its position in relation to the latter in the closed setting. The thrust follower itself may consist of a sliding pin or of a thrust follower roller. The setting device consisting of two intersecting longitudinal guides for the pivot pin of the spring-loaded lever renders possible a simple adjustment adapted to the desired setting characteristic.

Another advantageous feature of the invention is such that the stop member consists of a spring-loaded block with a thrust follower running on a cam, and is so supported on the one hand on a joint pin and on the other hand on the base plate or on an intermediate plate attached to the same that in the closed position the thrust follower maintains its relative position in relation to the cam. A suitably shaped block, which preferably consists of synthetic resin, may be mounted in the hinge without special guides having to be provided on the hinge arm, the base plate or the intermediate plate. Preferably the block is supported on the one hand by means of a slot guide on a joint pin and on the other hand by means of an oblique surface on edges constituting setting cam guides of the base plate or intermediate plate. Preferably the block is carried on the joint pin and a straight guide of the base or intermediate plate by means of guides or surfaces, which run together like a wedge.

Therefore in accordance with the invention the stop member is guided by guides or by support surfaces, which are so provided on the hinge arm and a fitting part fixedly joined to the support wall, in a sliding and/or pivoting fashion that on pivoting of the hinge arm for lateral adjustment of the door the stop member does not change its position relative to the cam of the joint lever acted upon by the stop member. The stop member is not fixedly joined to the hinge arm but is able to be moved by guides and/or transmission members positively with the latter in such a manner that it compensates for the pivoting of the joint levers, which correspond to a slight opening of the door owing to the lateral misalignment of the door.

What is important is that the guided movement of the stop member does not take place owing to a pivoting of the joint levers but merely owing to the pivoting of the hinge arm in relation to a base plate in such a manner that a certain lateral misalignment of the door or, respectively, a pivoting of the hinge arm corresponding to a setting adapted by the guides or transmission members, of the stop member in the hinge arm range, which leaves unchanged the effect of the closing moment produced by the stop member, on the door. Accordingly the guides for the stop member are so arranged that during the lateral setting the latter performs the same pivotal movement in relation to the hinge arm about the joint pin of the joint lever provided with the cam, which corresponds to a slight pivotal movement of the joint levers as a slight opening of the door so that the point of support of the pressing surface of the stop member on the cam of the joint lever remains the same.

In the case of the hinge in accordance with the invention the stop member is consequently able to be moved in two mutually independent fashions, that is to say on the one hand by means of the cam of the joint levers so that it exerts a moment in the closing direction just short of the closed setting, and on the other hand by means of guides or transmission members on pivotal movement of the hinge arm so that it compensates for the slight pivotal movement of the joint levers to produce a slight opening of the door so that the closing angle range, over which the closing moment is effective, remains unchanged. The first movement exclusively depends on the joint system. The second movement assumes the provision of guides, support surfaces or transmission members for the stop member, which are arranged between the hinge arm and a fitting part permanently connected with the support wall. Although this permanent fitting part could simply consist of the base plate itself, for reasons of simpler assembly it is advantageous to provide the hinge arm in a known fashion with an intermediate plate, which in the fitted state constitutes a fitted part of the hinge.

Another advantageous feature of the invention is such that the stop member is pivotally mounted between the hinge arm and the intermediate plate in a position which is changed by guides arranged on these fitting parts in a manner adapted to the relative position of the fitting part. This modification is independent from the respectively selected closing system, since the closing system merely has the function of transmitting a closing moment onto the joint levers. The stop member is consequently able to press against the cam of the joint lever past a certain support point, the pressing forces, which produces the closing force, being able to be produced in any suitable known fashion. The stop member itself may consist of a spring-loaded thrust follower or directly of a compression spring.

Working embodiments of the invention will now be described in detail with reference to the drawings.

DETAILED DESCRIPTION OF THE DRAWINGS

Figure 1:
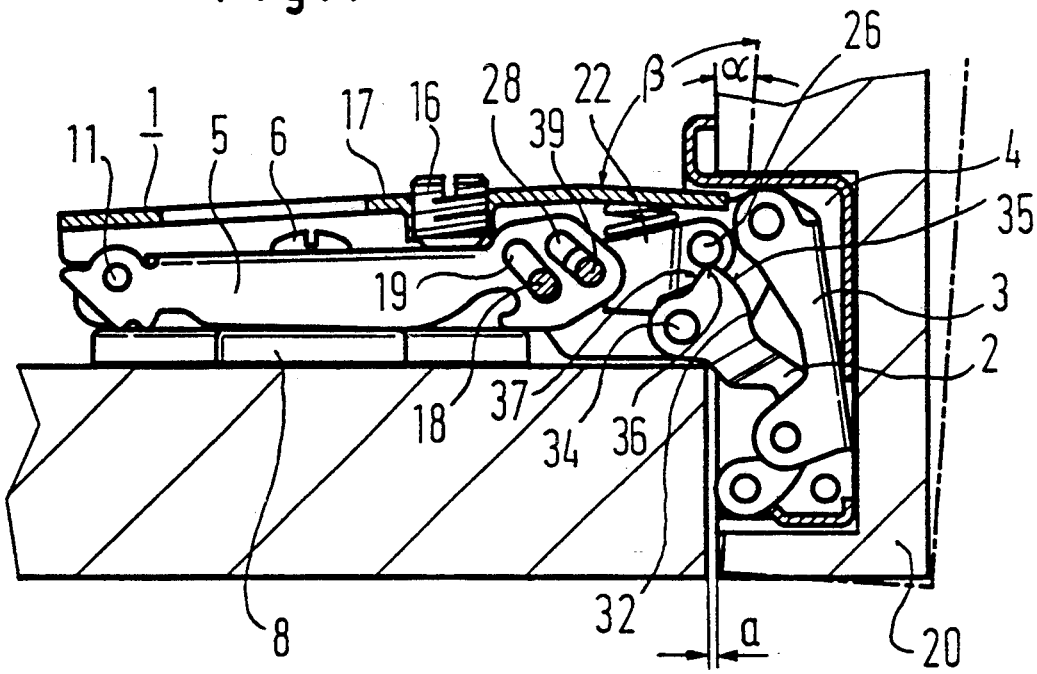
FIG. 1 is a lateral elevation of a first embodiment of the hinge in accordance with the invention in the case of which the hinge arm and the hinge female part are sectioned.

The hinge illustrated in FIGS. 1 through 7 consists of a hinge arm 1 with a U-shaped outline, which is connected pivotingly via two links 2 and 3 with a female pot-like part 4 constituting the pivotal part of the hinge. The hinge arm 1 is secured to an intermediate plate 5 with a U-shaped outline, which for its part is connected via an attachment screw 6 on a base-like, raised part 7 of the base plate 8. In a rear end part of its limbs 10, the intermediate plate 5 has pins 11 bent outwardly to extend away from the web part 9. The pins 11 are formed by suitable dents in the blank from which it is made, and from which the intermediate plate 5 is bent. The outwardly projecting pins 11 fit into freely extending slot-like holes 12 in the lateral limbs 13 of the hinge arm 1.

At the joint side end of its web part the intermediate plate 5 is provided with a slot-like recess 14, in which the part, provided with an annular groove 15, of a setting screw 16 is held so that it may move longitudinally and which is screwed into a screw hole in the web part 17 of the hinge arm 1, such hole being skirted. Between the limbs 13 of the hinge arm 1 a bolt 18 is held in the front part thereof and extends through two mutually parallel, obliquely extending slots 19 in the limbs 10 of the intermediate plate 5.

Figure 2:
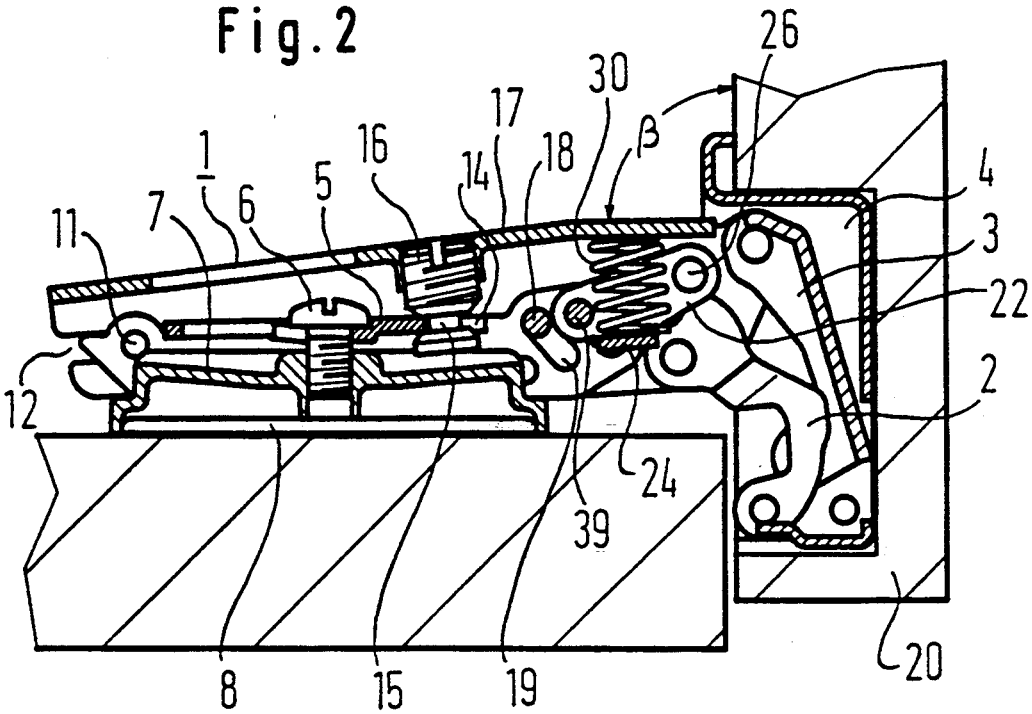
FIG. 2 is a longitudinal section taken through the hinge in accordance with FIG. 1.
Figure 3:
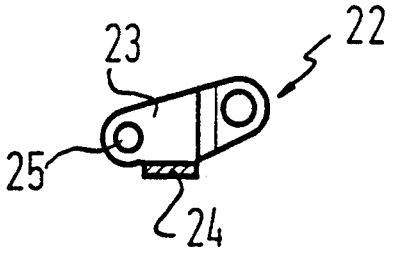
FIG. 3 is a section taken through the lever bearing the thrust follower.

Therefore, for lateral adjustment of the door 20, the setting screw 16 is turned, the hinge arm 1 is pivoted between its position depicted in FIG. 1 into the position illustrated in FIG. 2, and the bolt 18 will slide out of its lower position in slot 19, shown in FIG. 1, into the upper position in slot 19 illustrated in FIG. 2 so that the pivotal movement for lateral adjustment of the door will be modified by a translatory movement to the left in terms of the figures of the hinge arm so that in the case of this adjustment or setting movement, the gap remains constant. To this extent the design of the hinge is the same as that of the German Patent Publication 3,442,421 C, to which reference could be made.

In the case of the adjustment of the hinge arm 1 between the position depicted in FIG. 1 into the position illustrated in FIG. 2 the door will be pivoted in the direction of opening through the angle $\alpha$ which is indicated in FIG. 1 between the door shown in full lines and the door illustrated in chained lines. In the pivoted position depicted in FIG. 1 of the hinge arm 1, which corresponds to the maximum lateral displacement of the door 20, the door 20 assumes an obtuse angled position in relation to the hinge arm 1, such obtuse angle $\beta$ being marked in FIGS. 1 and 2.

The hinge depicted in FIGS. 1 through 7 is additionally provided with a closing device, which in a certain range before the shut position is effective for urging the door into its ultimate closed position. This closing device consists of branched lever 22 or stop member, whose branched limbs 23 are connected by a lower web part 24 with one another and are pivotally bearing on a bolt 39 extending through bearing holes 25 in the limbs 23, the bolt 39 being guided in obliquely extending slots 27 in the limbs 13 of the arm 1 and furthermore extending through obliquely extending slots 28 in the front parts of the limbs 10 of the intermediate plate 5, which extend generally parallel to the slots 19.

Figure 4:
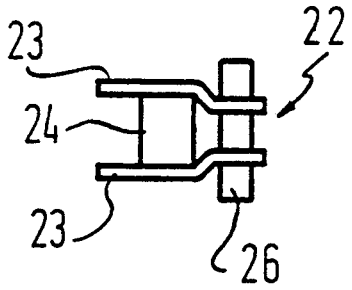
FIG. 4 is a plan view of the lever in accordance with FIG. 3.
Figure 5:
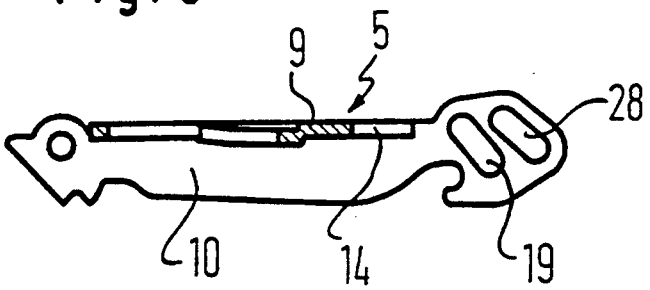
FIG. 5 is a longitudinal section taken through the intermediate plate.
Figure 6:
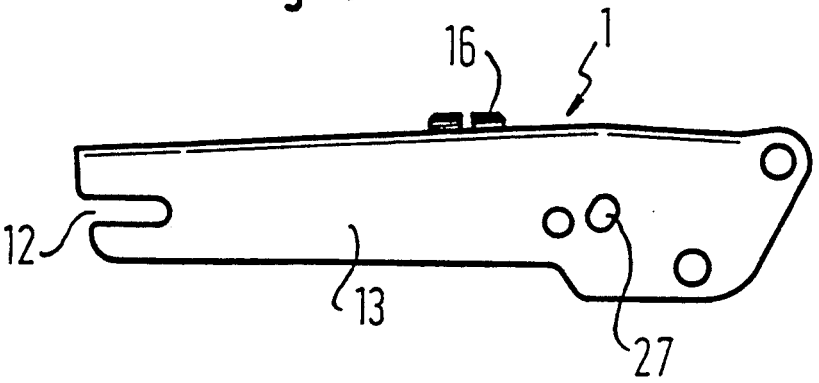
FIG. 6 is a lateral elevation of the hinge arm.

Between the web part 24 of the lever 22 and the web part 17 of the hinge arm 1 a tensioned compression spring 30 is held in the manner illustrated in FIG. 2. The limbs 23, which are bent at an angle in their front part as depicted in FIG. 4, of the lever 22 bear a bolt 26 in holes, which constitutes the thrust follower of the closing device.

Figure 10:
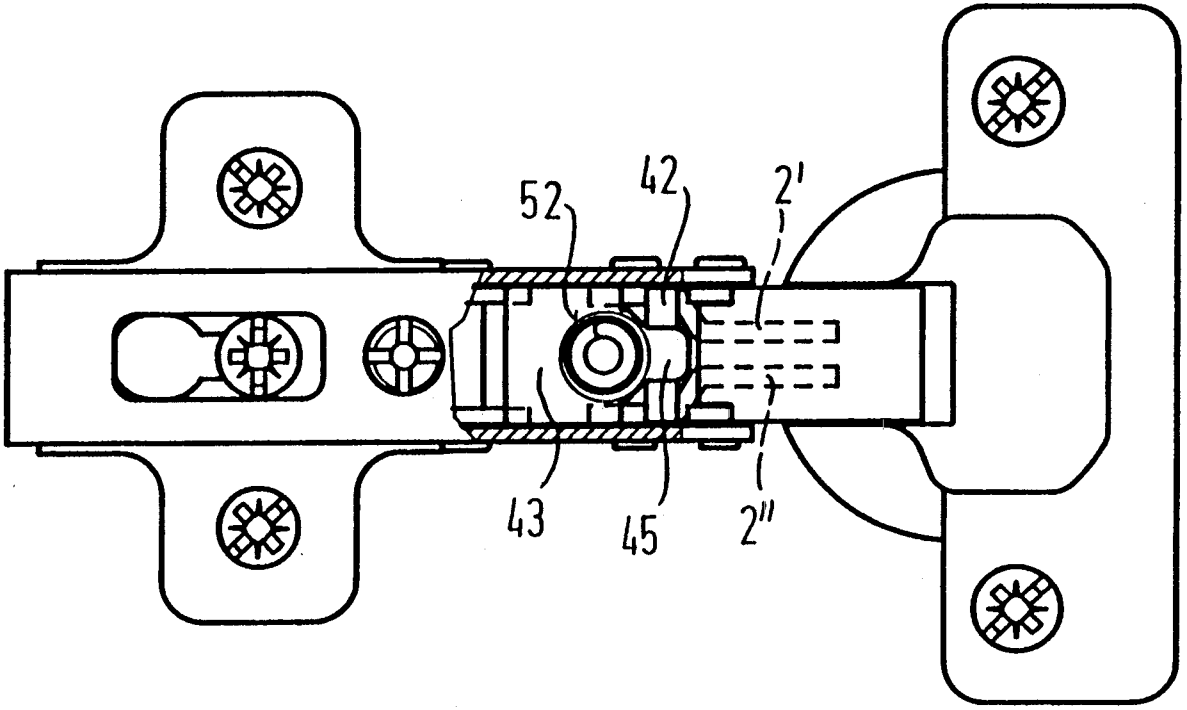
FIG. 10 is a plan view of the hinge in accordance with FIGS. 8 and 9 with the web part of the hinge arm partly broken away.

The bolt 26 cooperates with a cam 32, which is formed on the hinge arm end of the link 2. The link 2 consists of two mutually parallel levers 2' and 2'' as shown in FIG. 10. The two levers 2' and 2'' are angled with bilateral symmetry, the ends which are at a greater distance apart bearing on the joint pin 34 attached between the limbs of the hinge arm.

As shown more particularly in FIG. 1, the cam has a sector-like section 35 concentric to the joint pin 34, which merges via a rounded end part 36 with a section 37, which is quite close to the joint pin 34. As shown in FIG. 1 the bolt 26 acting as a thrust follower will have left the sector-like section 35 of the cam in the closed position and has just reached the section 37 coming close to the joint pin 34 after passing over the rounded end part 36. Accordingly the thrust follower bolt 26 acts via a lever arm constituted by the cam 32 to urge the door with a corresponding closing moment into the closed position and maintain it in the closed position.

It will readily be seen from FIG. 1 that the thrust follower bolt 26 would pass over the rounded end 36 connecting the sector-like cam part 35 with the descending curve part 37 of the cam onto the sector-like cam part 35, if the door 20 were to be pivoted through the angle $\alpha$ into the slightly opened position as shown in chained lines. If however this slightly opened position of the door is the position which it would assume after lateral adjustment as in FIG. 2, it would not be possible for the closing device to exert any or any substantial closing moment in the closing range of movement on the door.

Figure 7:
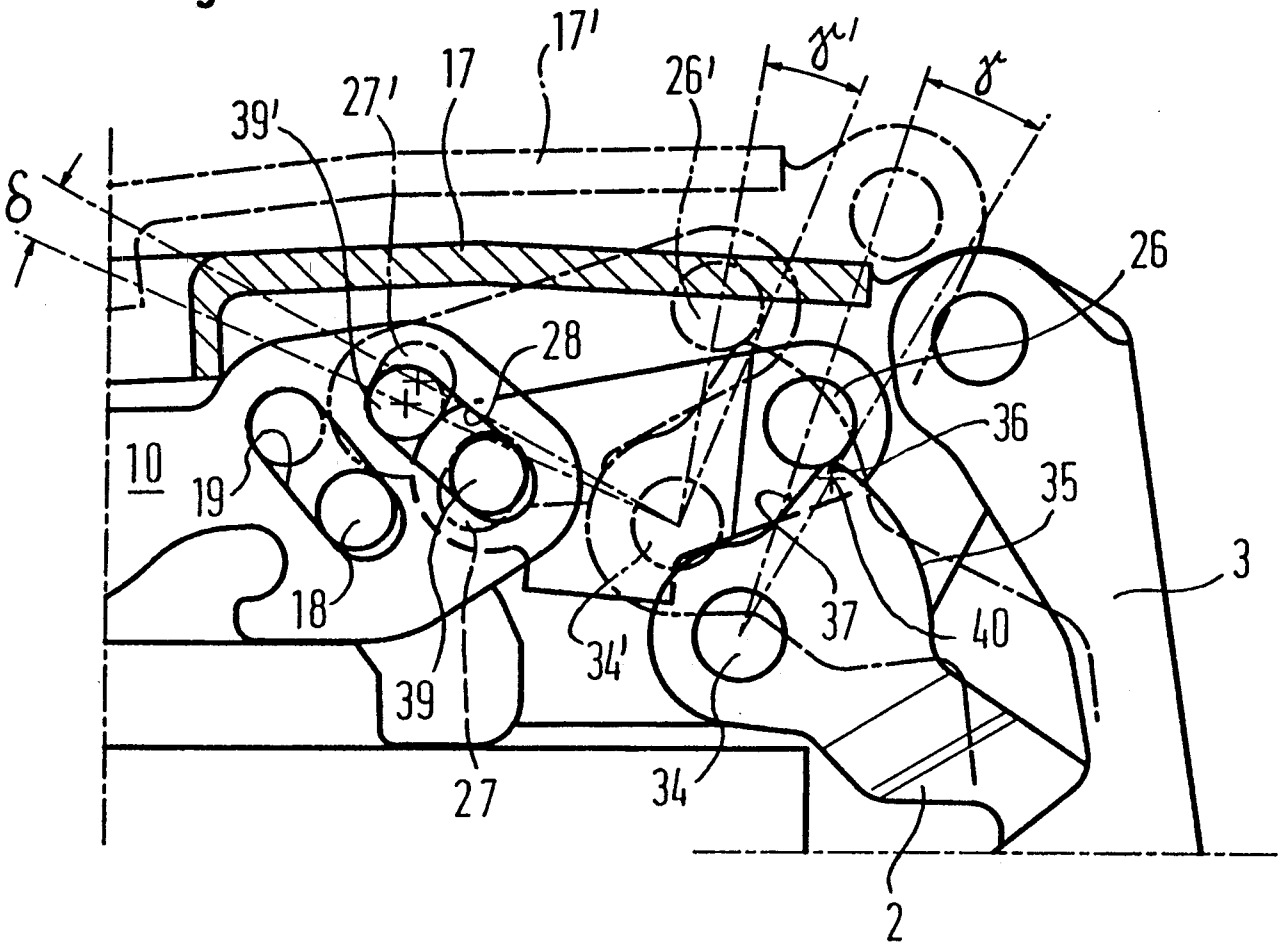
FIG. 7 is a lateral elevation of the front joint part of the hinge arm with the guides setting the joint pin and the thrust follower in two positions of pivoting of the hinge arm.

In order to ensure that in the lateral position of the door illustrated in FIG. 2 the closing device always exerts an equal closing moment on the joint levers, in the case of the door in accordance with the invention, there is the provision that a pivotal movement of the hinge arm 1 is furthermore accompanied by a movement of the joint pin 39 of the lever 22 in such a manner that for every lateral adjustment of the door the thrust follower pin bolt 26 assumes the same relative position as regards the cam 35. In this case when an adjustment illustrated in FIG. 7 is made, between the two end positions of the hinge arm depicted in FIG. 1, this is made possible because the joint pin 39 carrying the thrust follower lever 22 is guided in both the mutually parallel slots 27 in the limbs 13 of the hinge arm 1 and furthermore in the mutually parallel slots 28 in the limbs 10 of the intermediate plate 5 by sliding movement. As shown in FIG. 7 the center lines of the slots 27 and 28 intersect with one another.

If consequently the hinge arm 1 is pivoted between its position 17 marked in continuous lines in FIG. 7 into its position 17' as shown in chained lines, the joint pin 39 will be moved because it will pass from the lower position in the slot 28 into its upper position and from the upper position in the slot 27 into its lower position as shown in FIG. 7 in the slot 27'. In this respect the joint pin 39, will, owing to its displacement into the position 39', pivot through an angle $\delta$ about the joint pin 34 This pivotal movement compensates for the shift of the thrust follower member bolt 26 in the closing position, which would be performed by it owing to the pivotal movement of the hinge arm.

As shown in FIG. 7 in the two extreme end positions of the hinge arm, which corresponds to the two positions thereof depicted in FIGS. 1 and 2, in the closed position, the thrust follower bolts 26 and 26' are always at the same angle of $\gamma$ and $\gamma'$ between them and in relation to the center point 40 of the curvature 36, which connects the sector section cam curve part 35 with the steeply descending curve part 37. As shown in FIG. 7 owing to the movement of the pivot bolt 39 of the thrust follower lever 22 caused by the cam guide slots 27 and 28 in the case of every repositioning of the hinge arm, the joint pin of the thrust follower lever will be so pivoted that the thrust follower bolt 26 will not change its position in relation to the cam sections 35, 36 and 37.

The second working embodiment of the invention in accordance with FIGS. 8 through 13 differs from the embodiment of the invention in accordance with FIGS. 1 through 7 in that the thrust follower lever 22 is replaced by a block 43 or stop member bearing the thrust follower bolt 42. The embodiment of the invention in accordance with FIGS. 8 through 13 will merely be described to the extent that it is different from the embodiment of the invention in accordance with FIGS. 1 through 7 as regards the block 43 and its adjustment with a pivoting of the hinge arm 1.

Figure 11:
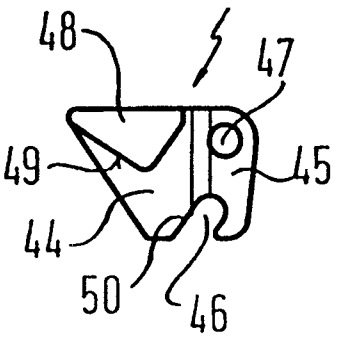
FIG. 11 is a lateral elevation of the block bearing the thrust follower.
Figure 12:
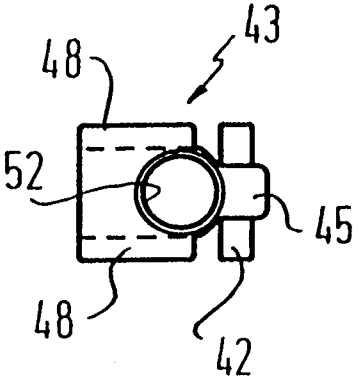
FIG. 12 is a plan view of the block in accordance with FIG. 11.

The configuration of the block 43 is best seen from FIGS. 11 and 12. The block consists of a body 44 which as seen from the side is generally triangular and which has a set back prolongation 45. Between the body 44 and the prolongation 45 there is a freely extending slot-like recess 46. In its upper part, the prolongation 45 has a transverse hole 47, in which the thrust follower bolt 42 is held. Furthermore the block is provided at both ends with triangular projections 48, whose rear ends 49 constitute guide paths, which extend at an angle to the inner guide path 50 defining slot-like recess 46. On its upper side, the block 43 is provided with a blind hole 52.

Figure 8:
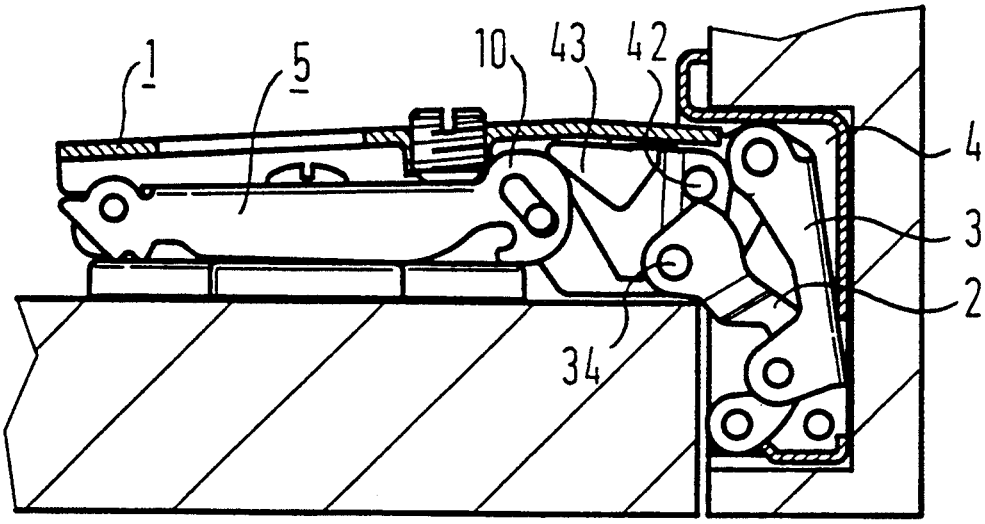
FIG. 8 is a representation corresponding to FIG. 1 to show a second working embodiment of the hinge in accordance with the invention.
Figure 9:
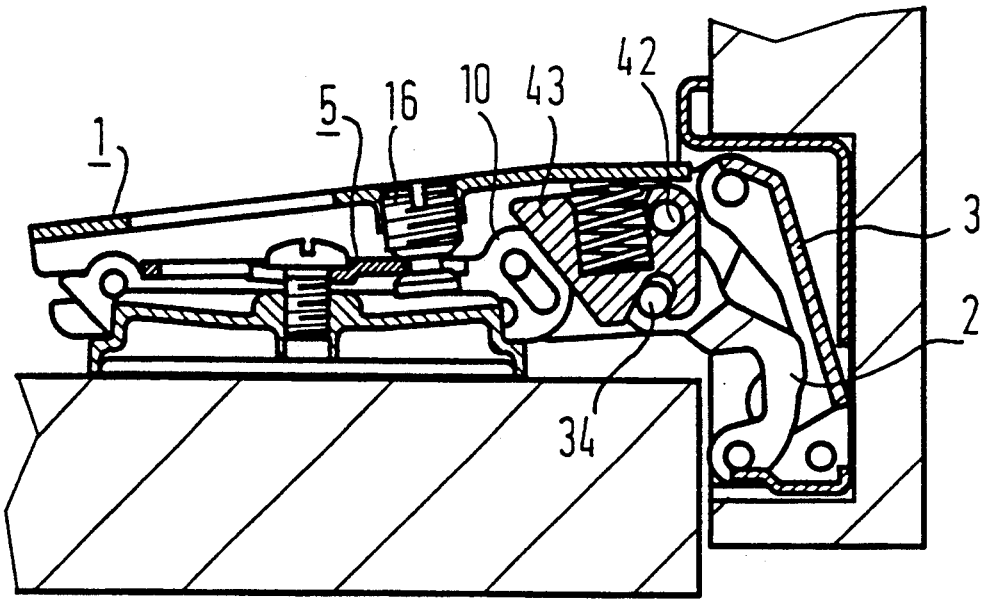
FIG. 9 is a longitudinal section taken through the hinge in accordance with FIG. 8.
Figure 13:
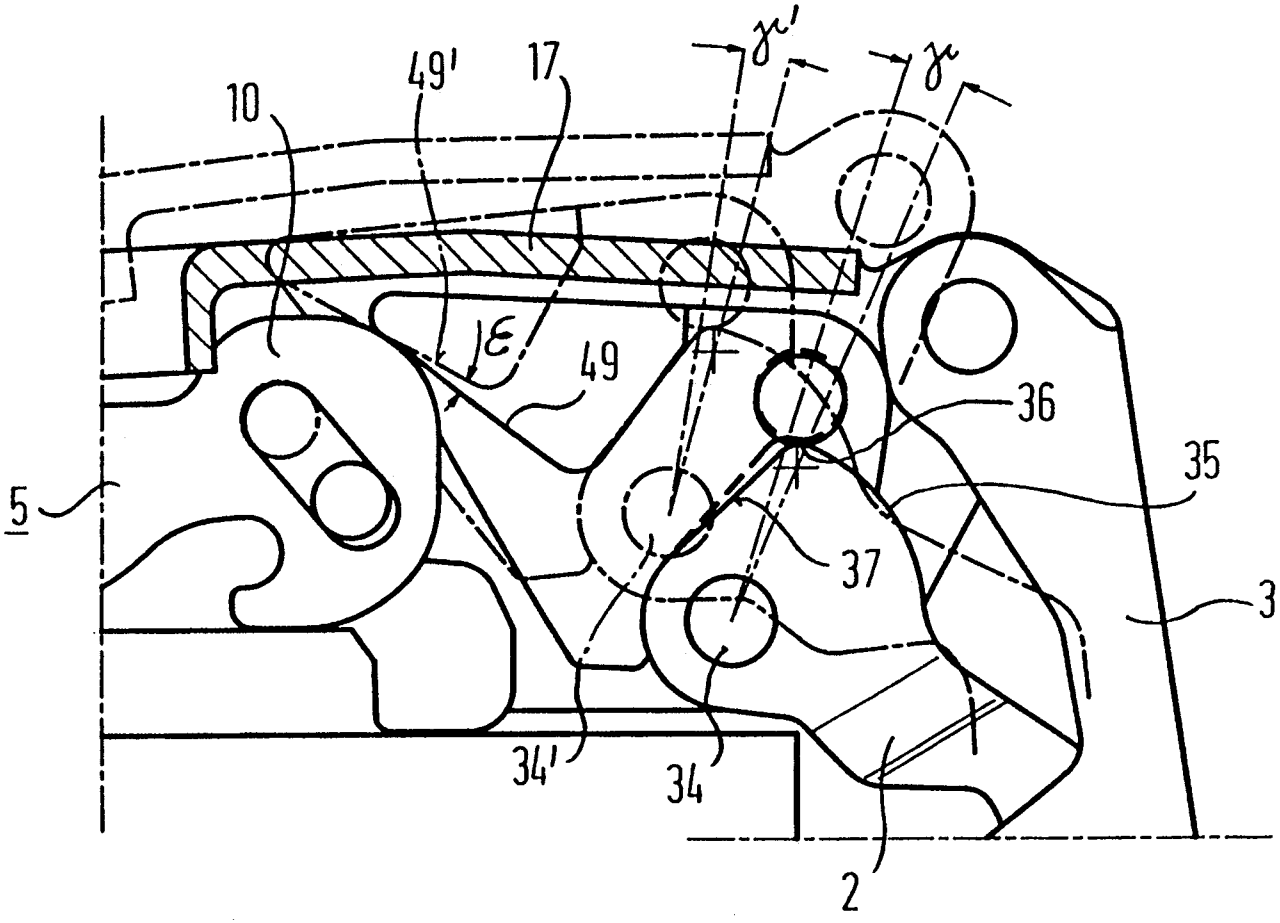
FIG. 13 is a representation corresponding to FIG. 7 of the second embodiment of the hinge.

As shown in FIGS. 8 and 9 the block 43 is so inserted between the joint pins 34 of the thrust follower bolt 42 and the front edges of the front ends of the limbs 10 of the intermediate plate 5 that the guide paths 49 and 50 thereof bear on the edges of the limbs and the pin 34. The guide paths 49 and 50 intersect with one another in the manner illustrated in FIG. 11 so that during a setting movement of the hinge arm 1 the block 43 will perform a movement as shown in FIG. 13, which consists of a pivotal movement through an angle $\epsilon$, which is modified by a translatory movement to the left. Accordingly, in the case of an adjustment of the hinge arm, the block 43 will perform a movement, which will so modify the position of the thrust follower bolt that the latter will in all pivot positions again assume its relative position as regards the cam parts 35, 36 and 37. As shown in FIG. 13 after a pivotal movement of the hinge arm the angle of $\gamma$ and, respectively, $\gamma'$ between the thrust follower bolt 42 and the cam in the closed position will not be changed.

As shown in FIG. 10, the block 43 has its prolongation 45 so extending past the joint pin 34 that it fits between the hinge arm side part and the outwardly angled part of the link 2 and levers 2 and 2' arranged with bilateral symmetry.

The block 43 has the advantage over the thrust follower lever 22 that no additional slot guides have to be provided in the limbs of the hinge arm and of the intermediate plate.

Having described the invention, many modifications thereto will become apparent to those skilled in the art to which it pertains without deviation from the spirit of the invention as defined by the scope of the appended claims.

I claim:

1. A hinge comprising:

a stationary fitting part in the form of a hinge arm with a base plate carrying said stationary fitting part, said stationary fitting part being connected via pivot levers with a pivotal fitting part, and said pivotal fitting part being pivotable for lateral adjustment of a door or flap carried by the pivotal fitting part in relation to the base plate by a setting device located in a pivot plane of the hinge, a stop member bearing on the hinge arm and being acted upon by a resilient element, said stop member acting upon a cam, being pivotable with the pivotal fitting part so as to urge the pivotal fitting part, in a closing part of its range of movement, towards a closed position and outside said closing part of its range of movement, said stop member being free of effect by said cam, said stop member being connected to the hinge arm and with the base plate by means for moving said stop member by each pivotal movement of the hinge arm in relation to the base plate into a setting, in which said stop member maintains substantially a same position in relation to the cam in the closed position.

2. The hinge as claimed in claim 1, wherein the pivotal fitting part is connected by two joint levers with the hinge arm, of which one bears on the cam adjacent to a joint pin on the hinge arm.

3. A hinge comprising:

a stationary fitting part in the form of a hinge arm with a base plate carrying said stationary fitting part, said stationary fitting part being connected via pivot levers with a pivotal fitting part, and said pivotal fitting part being pivotable for lateral adjustment of a door or flap carried by the pivotal fitting part in relation to the base plate by a setting device located in a pivot plane of the hinge, a stop member bearing on the hinge arm and being acted upon by a resilient element, said stop member acting upon a cam, being pivotable with the pivotal fitting part so as to urge the pivotal fitting part, in a closing part of its range of movement, towards a closed position and outside said closing part of its range of movement, said stop member being free of effect by said cam, said stop member being connected to the hinge arm and with the base plate by means for moving said stop member by each pivotal movement of the hinge arm in relation to the base plate into a setting, in which said stop member maintains substantially a same position in relation to the cam in the closed position, said stop member including a spring-loaded lever, having a joint pin guided in slot guides in the base plate and a thrust follower member of said stop member cooperating with said cam and maintaining its position in relation to said cam after every adjustment in the closed position.

4. A hinge comprising:

a stationary fitting part in the form of a hinge arm with a base plate carrying said stationary fitting part, said stationary fitting part being connected via pivot levers with a pivotal fitting part, and said pivotal fitting part being pivotable for lateral adjustment of a door or flap carried by the pivotal fitting part in relation to the base plate by a setting device located in a pivot plane of the hinge, a stop member bearing on the hinge arm and being acted upon by a resilient element, said stop member acting upon a cam, being pivotable with the pivotal fitting part so as to urge the pivotal fitting part, in a closing part of its range of movement, towards a closed position and outside said closing part of its range of movement, said stop member being free of effect by said cam, said stop member being connected to the hinge arm and with the base plate by means for moving said stop member by each pivotal movement of the hinge arm in relation to the base plate into a setting, in which said stop member maintains substantially a same position in relation to the cam in the closed position, said stop member including a spring-loaded block with a thrust follower member sliding on said cam, said thrust follower member bearing on a joint bolt and on said base plate so that after every adjustment of said hinge arm, said thrust follower member maintains its relative position as regards said cam.

5. The hinge as claimed in claim 4, wherein said block has one flank bearing on a slot guide on a joint pin and has oblique surfaces bearing on edges constituting setting cams of said base plate.

6. The hinge as claimed in claim 4, wherein said block bears on a joint pin and a straight guide of said base plate by guide surfaces, which intersect with each other.

* * * * *